United States Patent [19]

Phillipson

[11] Patent Number: 4,858,772

[45] Date of Patent: Aug. 22, 1989

[54] CAROUSEL ACCESSORY UNIT

[76] Inventor: Theodore Phillipson, 5209 Paleo Pines, Fort Pierce, Fla. 33451

[21] Appl. No.: 121,903

[22] Filed: Nov. 17, 1987

[51] Int. Cl.[4] ..... A47F 7/08

[52] U.S. Cl. ..... 211/36; 211/34; 211/115; 211/144; 211/188

[58] Field of Search ..... 211/34, 35, 36, 188, 211/194, 95, 115, 90, 163, 144

[56] References Cited

U.S. PATENT DOCUMENTS

| | | | |
|---|---|---|---|
| D. 169,429 | 4/1953 | Enrich . | |
| 443,920 | 12/1890 | Reed | 211/163 |
| 889,517 | 6/1908 | Gerken | 211/115 X |
| 1,583,784 | 5/1926 | Erickson | 211/163 X |
| 2,082,088 | 6/1937 | Wilson | 211/34 |
| 2,613,735 | 10/1952 | Fisher | 211/36 X |
| 2,635,764 | 4/1953 | Mattocks | 211/95 |
| 2,754,166 | 7/1956 | Ohm | 211/95 X |
| 2,845,182 | 7/1958 | Atkinson | 211/37 |
| 2,943,899 | 7/1960 | Beller | 312/3 |
| 3,135,389 | 6/1964 | Farley | 211/37 |
| 3,331,513 | 7/1967 | Cappelli | 211/34 |
| 3,478,890 | 11/1969 | Allsop | 211/37 |
| 3,596,077 | 7/1971 | Miazga | 211/34 |
| 3,780,875 | 12/1973 | Scholl | 211/163 X |
| 4,036,367 | 7/1977 | Stambaugh et al. | 211/37 |
| 4,219,248 | 8/1980 | Goldberg | 211/36 X |
| 4,549,714 | 10/1985 | Busch | 248/349 |
| 4,603,781 | 8/1986 | Ryan | 211/90 |

FOREIGN PATENT DOCUMENTS

| | | | |
|---|---|---|---|
| 220821 | 9/1957 | Australia | 211/115 |

*Primary Examiner*—Robert W. Gibson, Jr.
*Attorney, Agent, or Firm*—Malin, Haley & McHale

[57] ABSTRACT

A shoe and accessory carousel storage unit designed to accomodate men's and women's shoes, ties, belts, necklace and the like. The carousel is stackable in multiple units or can be used individually. The unit is readily convertible from a hook type shoe rack to a multi-shelf unit. Two separate support systems are disclosed for providing rotation to the unit. One approach being the provision of a rotatable base, and the other being the provision wherein the unit or units can be rotatably suspended from conventional closet shelving, either metallic or wooden.

16 Claims, 1 Drawing Sheet

CAROUSEL ACCESSORY UNIT

BACKGROUND OF THE INVENTION

Over the years many types of storage units have been designed to accomodate various accessories used by the male and female occupants of an average household. For example, there seems to be an endless variety of shoe racks. Some being mounted to the wall of a closet, some being placed on the floor and supported by various types of frame structures. Another version is the fabric type with a plurality of pockets adapted to receive shoes which is generally fastened to the back side of a door. Similarly, there is an equally large number of different types of tie racks, belt racks, etc. However, all these prior art support devices suffer from one or more drawbacks. Many are too cumbersome, take up extensive space. Others are safety hazards in that they usually project outwardly from a door, door frame or closet at eye level thus subjecting the home occupant to possible serious injury and others simply do not provide satisfactory service to the user.

Another disadvantage of the prior art devices is the fact that most are stationary and only a single item is usually accomodated thereon. A further disadvantage being the lack of flexibility as to the purposes for which these devices can be used, i.e. they are designed for a single purpose and one purpose only.

SUMMARY OF THE INVENTION

A multi-use, stackable shoe and accessory storage device made in accordance with the principles of the present invention may comprise a rotatable base unit with a first shoe and accessory unit mounted thereon. Additional units may be mounted above the first unit and means are provided wherein any of the units may be provided with a plurality of spaced shelves. A second embodiment is provided wherein a single or multiple units may be suspended by means of a novel swivel adapter which can readily suspend the units from a metallic grid-like shelf or from a conventional wooden shelf as found in most closets. The rotatable unit's circular configuration permit their use in corners or other dead-use areas, commonly found in the home.

Provision is made for a separately designed utility tray that can be permanently mountable on the uppermost shelf of the stacked units and useful with either type of mounting. This unit provides a readily accessible storage area for items such as lipstick, makeup, earrings, tissues, and the like.

OBJECTS OF THE INVENTION

An object of the invention is to provide a shoe and accessory carousel storage unit which can readily be accomodated in a closet, in a corner, or other inaccessible areas of the home.

A still further object of the invention is the provision of a shoe and accessory carousel storage unit which is convertible from a shoe accessory carousel unit to a multi-shelf carousel unit.

Yet another object of the invention is to provide a shoe and accessory carousel unit which can be manufactured economically from steel, wood or other materials.

Another object of the invention is to provide a shoe and accessory carousel storage unit which can be used singularly or as multiple units stacked or hung vertically.

Still another object of the invention is the provision of a floor supported rotary base unit which supports the shoe accessory carousel unit or units.

Yet another object of the invention is to provide a shoe and accessory storage unit wherein the shoe hanger assembly can be raised or lowered to accommodate men's or women's shoes.

A further object of the invention is to provide a novel suspension block assembly which is usable with either steel grid-like shelving or wooden shelving to provide rotary support for a hanging shoe and accessory carousel unit, or other rotatable devices.

Another object of the invention is the provision of a novel compartmented utility tray which can be used in combination with the upper surface of the shoe and accessory carousel unit.

A still further object of the invention is the provision of a shoe and accessory carousel storage unit which can readily be assembled and mounted requiring a minimum amount of effort and skill by the installer.

These and other objects of the invention will become more apparent in the following description and appended claims, reference being made to the accompanying drawings which form a part of this specification wherein like referenced characters designate corresponding parts in the several views.

DESCRIPTION OF THE PREFERRED EMBODIMENT

Figure 1:
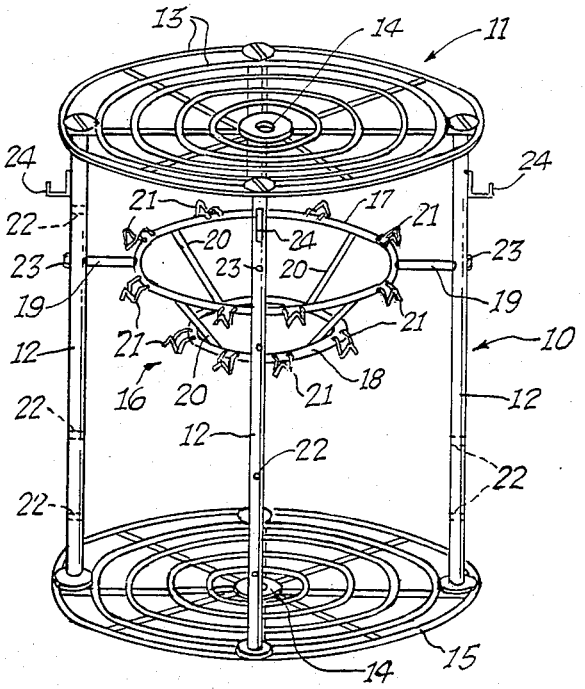
FIG. 1 is an elevational perspective view illustrating the carousel unit.

Referring to FIG. 1 there is shown a preferred embodiment of the carousel unit 10 which comprises an uppermost shelf 11 which is interconnected by a plurality of spaced vertical support legs 12. Although upper shelf 11 is shown formed by a plurality of spaced concentric rings 13 with a central aperture 14 therein, they could take the form of a solid disk or other configuration with a central aperture and made of plastic, plywood or the like. Lower ends of support legs 12 are connected to a lowermost shelf 15 similar in configuration to that of uppermost shelf 11. Shelf 15 may alternatively take the form of a solid disk or other configuration. Positioned between upper and lower shelves 11 and 15 is shoe hanger assembly 16 which consists of an upper ring 17 and a lower ring 18 of a lesser diameter. Horizontal struts 19 project radially from upper ring 17 for interconnection with legs 12. Lower ring 18 is supported by a plurality of spaced diagonal struts 20. Each of rings 17 and 18 are provided with a plurality of circumferentially spaced shoe hooks 21. Shoe hanger assembly 16 is in its lower position which permits the convenient hanging of women's shoes, both formal and casual. In the event that the carousel unit 10 is to be used for men's shoes, a second set of apertures 22 are provided in legs 12 whereby shoe hanger assembly 16 may be moved up after removing screws 23, into alignment with uppermost apertures 22 and then reinserting screws 23 into horizontal struts 19. The additional height gained by moving hanger assembly 16 up to its new position guarantees that there will be sufficient space for men's shoes. Legs 12 are provided with outside accessory hooks 24 which can serve to hang ties, belts, scarves or the like.

Figure 10:
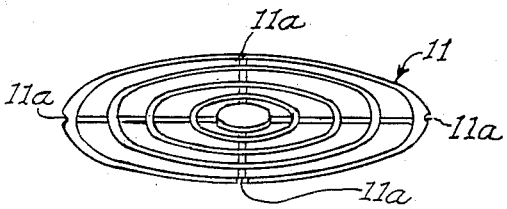
FIG. 10 illustrates the replacement of shelves.

In the event that the user of the carousel unit does not desire to utilize the shoe hanger assembly 16 it can be readily removed and replaced with a circular shelf similar to uppermost shelf 11 as shown more clearly in FIG. 10. Additional shelves 11 may be added in spaced relation by utilizing additional sets of apertures 22.

Figure 2:
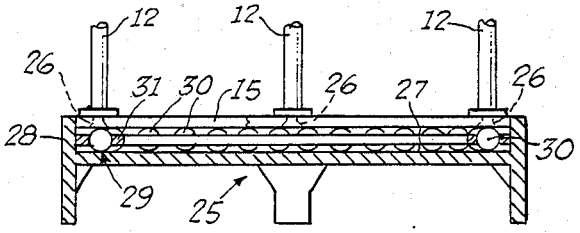
FIG. 2 is an illustration of a rotatable base unit usable with the carousel unit.

Referring now to FIG. 2 there is shown rotary base unit 25 with the lower portion of carousel unit 10 positioned thereon. The lowermost shelf 15 is attached to legs 12 by bevelled screws 26 which are threaded into the bottom of legs 12, thus presenting a smooth underside. Rotary base unit 25 consists of a recessed upper surface 27 formed by peripheral rim 28 to receive lowermost shelf 15. Rotary base unit 25 is also provided with a plurality of legs 25A which are formed integrally with base 25. Positioned within recess 27 is bearing ring 29 which consists of a plurality of ball bearings 30 rotatably mounted in a conventional circular cage 31. Since the outside diameter of circular cage 31 conforms to the inside diameter of peripheral rim 28, there can be no lateral movement of circular cage 31. Ball bearings 30 have a diameter which is greater than the thickness of circular cage 31 thus permitting ball bearings to project out above and below cage 31. The undersurface of lowermost shelf 15 engages ball bearings 30 while the bottom surface of ball bearings 30 ride on the recessed upper surface 27 permitting rotation of carousel unit 10 at a finger's touch.

It should be noted that a second or third carousel unit may be securely mounted on top of the first carousel unit 10 which is rotatably supported by rotary base unit 25. The second or third carousel unit 10 can be permanently attached to the first carousel unit 10 by inserting a bolt (not shown) through aperture 14 which is located in the center of upper and lowermost shelves 11 and 15, then securing with a nut (not shown). If desired, the second or third carousel unit 10 may be provided with circular shelves 11 or vice versa, i.e. the upper carousel units 10 may be provided with shelves 11 and the lower carousel unit 10 provided with the hanger assembly 16. This interchangeability in stacking the carousel units 10 is one of the outstanding features of the invention since it lends a greater degree of flexibility to the user.

Figure 3:
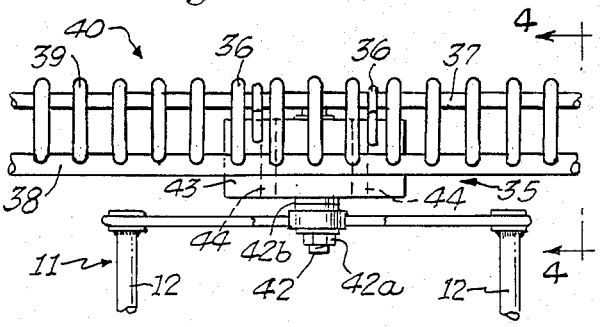
FIG. 3 is a front view of the suspension adapter.

Referring now to FIG. 3 wherein a novel suspension block 35 is shown as providing rotary support for carousel unit 10. In the event that the user does not desire to use the rotary base unit 25 described above, provisions have been made wherein a single or plural carousel units 10 or other rotatable devices may be suspended from conventional shelving found in most clothes closets. Suspension block 35 is shown as being provided with a pair of spaced hooks 36 which are engaged with the upper rail 37 of steel shelf 40. Upper rail 37 and lower rail 38 are interconnected by a plurality of spaced perpendicularly disposed support runners 39 which are bent at right angles with the outermost ends welded to lower rail 38 and welded again at the 90° bend to upper rail 37 then extend horizontally approximately twelve inches with the rear end (not shown) of support runners 39 similarly attached to another pair of rails. Appropriate support brackets are used to support steel shelves 40. The shelving may wooden shelving. A white vinyl coating is usually applied to steel shelving to prevent corrosion and also provide a pleasing appearance. Shelving of this type is readily available in most home supply stores and is available in various lengths to permit the purchaser to cut it to the desired length.

Suspension block 35 is also provided with a central bore 41 to which bolt 42 is inserted and the lower end of which extends through central aperture 14. As can be seen best in FIG. 3, suspension block 35 is of sufficient width such that it will resist any free swinging or twisting motion due to the fact that it is suspended from upper rail 37 by a pair of horizontally spaced hooks and also because the front face 43 of mounting block 35 is in engagement with lower rail 38. Another unique feature of suspension block 35 is the fact that it can also be used with a wooden shelf should the need arise. To accomodate use with a wooden shelf, suspension block 35 is provided with a pair of spaced vertical predrilled holes 44. Front face 43 of suspension block 35 is vertically aligned with the front face of wooden shelf (not shown) with the top surface of suspension block 35 engaging the under surface of the shelf, then wood screws are screwed through predrilled holes 44 and into the wooden shelf to securely attach the suspension block 35. Having mounted suspension block 35 to the shelving, whether it be steel shelving or wooden shelving, the carousel unit is ready for attachment to suspension block 35 by means of bolt 42, nut 42A, and washer 42B.

Figure 4:
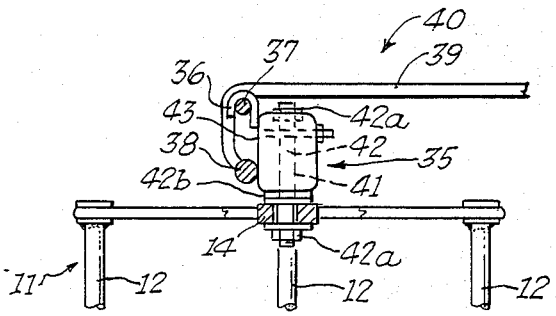
FIG. 4 is a side view of the suspension adapter looking in the direction of arrows 4—4.

Referring now to FIG. 4 which is a side view looking in the direction of arrows 4—4 of FIG. 3. This view is a clear showing of how spaced hooks 36 cooperate with upper rails 37 and further show suspension block 35 in close engagement with lower rail 38 thereby preventing any free swinging or twisting of suspension block 35 when carousel unit 10 is rotated.

The suspension block 35 has a main support member 43 with a central bore and a pair of pre-drilled holes in opposite sides of said central bore. Screws are placed in the pre-drilled holes into a wooden shelf to mount the main support member. Attachment means extend from the bottom of the main support member to connect the shoe and accessory unit.

Figure 5:
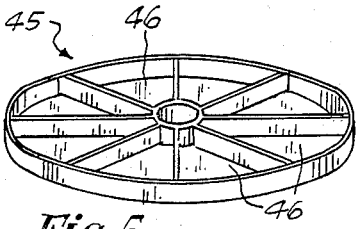
FIG. 5 is a showing of the utility tray useable with FIG. 1.

FIG. 5 shows the circular utility tray 45 which is provided with a plurality of irregular shaped compartments 46. The outside diameter of the utility tray 45 conforms to the outside diameter of uppermost shelf 11 of carousel unit 10 and permits placement thereon when carousel is used with rotary base unit 25. Items such as earrings, lipstick, makeup and the like can be conveniently stored therein.

Figure 6:
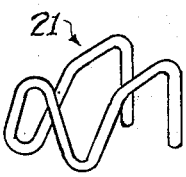
FIG. 6 is a view of a shoe hook means used in FIG. 1.

FIG. 6 is an illustration of the shoe hooks 21 as found in FIG. 1. Shoe hooks 21 can be mass produced from a roll of appropriate gauge wire wherein the cutting and bending take place in a multi-step operation.

Figure 7:
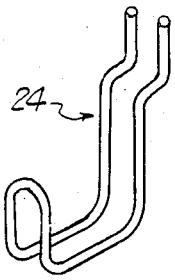
FIG. 7 is a perspective view of the accessory hook means used in FIG. 1.

FIG. 7 is a perspective view of accessory hook 24 as found in FIG. 1. It is to be noted that accessory hook 24 is provided with sufficient width to permit convenient hanging of a plurality of items such as ties, belts, scarves, and the like.

Figure 8:
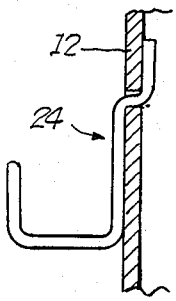
FIG. 8 is a side view of the hook means of FIG. 7 showing its mounting to the support post.

FIG. 8 is a showing of the manner in which accessory hook 24 is securely positioned relative to vertical legs 12 with only the outer wall of leg 12 being shown.

Figure 9:
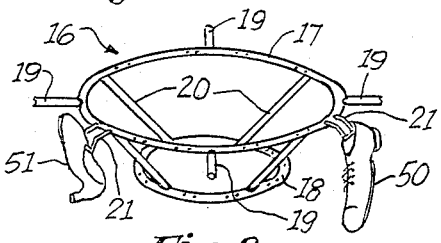
FIG. 9 illustrates the manner of supporting men's and women's shoes.

FIG. 9 is a showing of the manner in which shoe hanger assembly 16 is utilized to support men's shoes 50 as well as women's formal shoes 51. Women's casual shoes could be suspended from hooks 21 in the same manner as man's shoe 50. A woman's formal or high-heeled shoe 51 could be supported by the instep portion of the shoe as illustrated in FIG. 9. While both a man's shoe 50 and a woman's shoe 51 are shown as being supported simultaneously from shoe hanger assembly 16, this may not be possible when shoe hanger assembly 16 is mounted from carousel unit 10 due to the vertical space limitation. Therefore an upper set of apertures 22 is provided, see FIG. 1, to accomodate men's shoes. However it is possible to hang men's shoes in the lower position of shoe hanger assembly 16 providing the size of the shoe is not too large.

FIG. 10 is an illustration of uppermost shelf 11. Although shelf 11 is shown as a plurality of spaced interconnected rings made of steel, shelf 11 could just as well be made of plastic, wood or other materials and consist of a circular disk or other configuration rather than concentric rings. Shelf 11 is shown with four peripherally spaced apertures 11A to permit mounting of a shelf 11 on the legs 12 of carousel unit 10. Shelf 11 is pulled down, with legs 12 vertically positioned between the outermost and next inner concentric rings 11, into alignment with the desired set of apertures 22 on legs 12. Then screws are inserted through apertures llA into apertures 22 and tightened. The same procedure follows for each additional shelf to be added to the carousel unit 10.

The unit 10 is hung of wire shelving in closets by a hook 36 as shown in FIGS. 3 and 4. It should be noted that a unit hung on shelving as shown in FIGS. 3, 4 and 1 may have a second unit, similar to unit 10 in FIG. 1, hung on to the bottom of unit 10 by a hook 36 disclosed to support unit 10. This provides a tandem arrangement.

While the invention has been described in its preferred embodiment, it is to be understood that the words which have been used are words of description rather than limitation and that changes may be made within the purview of the appended claims without departing from the scope or spirit of the invention.

Having thus described my invention, I claim:

1. A shoe and accessory support unit comprising an upper circular shelf means, base means including a second circular shelf, a plurality of spaced vertical leg members fixedly positioned between said upper shelf means and said base means, attachment means provided on said spaced vertical leg members, a two position shoe hanger assembly supported by said attachment means and selectively positioned in one of said two positions below said upper circular shelf means, and accessory hook means supported by said attachment means on the upper end of each of said spaced vertical leg members whereby shoes can be suspended from said shoe hanger assembly and accessories such as ties, belts and scarves can be suspended from said accessory hook means.

2. A shoe and accessory support unit of the character defined in claim 1 wherein said upper shelf means is formed by a plurality of interconnected vinyl coated concentric steel rings with a central aperture therein, said upper shelf means serving as support for a second shoe and accessory unit when so stacked, said base means providing support for said plurality of leg members when said shoe and accessory support unit is used singularly or in stacked relation with a second shoe and accessory support unit.

3. A shoe and accessory unit of the character defined in claim 1 wherein said shoe hanger assembly is supported by said attachment means in the other of said two positions whereby the vertical clearance is increased sufficiently to accomodate men's shoes.

4. A shoe and accessory unit of the character defined in claim 1 wherein said two position shoe hanger assembly is removed and an additional shelf is substituted therefor with additional shelves attached to said spaced vertical leg members at predetermined spaced intervals by said attachment means.

5. A shoe and accessory support unit of the character defined in claim 4 wherein said attachment means comprises pre-drilled apertures in said leg members and said shelves cooperating with screws to securely position said shelves thereon.

6. A shoe and accessory support unit of the character defined in claim 1 wherein said base means further includes a rotary base unit, said rotary base unit comprising a circular support member, said circular support member having a plurality of spaced legs, a peripheral rim attached to said circular support member, said peripheral rim projecting above the upper surface of said circular support member, and having an internal diameter conforming to the outside diameter of said second circular shelf, bearing means positioned between said second circular shelf and said circular support member whereby said shoe and accessory support unit can be rotated at a finger's touch relative to said circular support member.

7. A shoe and accessory support unit of the character defined in claim 1 wherein said shoe hanger assembly comprises a first annular member, a plurality of radial struts projecting at spaced intervals from said first annular member, a plurality of shoe hook means attached to the periphery of said first annular member, a second annular member positioned below said first annular member, said second annular member havihg a lesser diameter than said first annular member and being attached thereto by a plurality of inwardly directed diagonal struts, said second annular member also provided with a plurality of shoe hook means.

8. A rotatable shoe and accessory support means comprising:

a first rotatable shoe and accessory unit including and connected to shelving means and including suspension block means connected to said shelving means for providing vertical rotary support for said first rotatable shoe and accessory unit from above structure, said first rotatable shoe and accessory unit including an upper shelf and a lower shelf, a plurality of spaced vertical leg members interconnecting said upper shelf and lower shelf, a shoe hanger assembly securely connectable to said vertical leg members between said upper self and said lower shelf, said shoe hanger assembly accommodating men's shoes in one position and accommodating women's shoes in another position, and hook means connected to and positioned on said plurality of spaced vertical leg members for supporting other wearable accessories such as ties, belts, and scarves.

9. The combination as set forth in claim 8, wherein said suspension block means comprises a main support member, a plurality of spaced hooks projecting from said main support member for engaging one of said further pair of horizontal steel rods, a frontal face of said main support member engaging the other of said further pair of horizontal steel rods to prevent twisting of said main support member and rotary attachment means projecting from the bottom of said main support member and secured to said first rotatable shoe and accessory unit whereby said first rotatable shoe and accessory unit is suspended from said steel shelving by means of said main body member.

10. The combination as set forth in claim 9 wherein said first rotatable shoe and accessory support means further comprises an additional shoe and accessory unit attached in tandem to the lower end of said first rotatable shoe and accessory unit.

11. Rotatable shoe and accessory support means comprising a first rotatable shoe and accessory unit including and connected to shelving means and including and connected to suspension block means connected to said shelving means for providing vertical rotary support for said rotatable first shoe and accessory unit, said block means includes a hanging means to connect to an above structure, said shelving means is a wooden shelf, said suspension block means comprises a main support member, said main support member having a central bore and a pair of pre-drilled holes on opposite sides of said central bore, a pair of screws extending through said pre-drilled holes into said wooden shelving securely mounting said main support member to said wooden shelving, attachment means extending from the bottom of said main support member operatively connected to said rotatable shoe and accessory unit, whereby said rotatable shoe and accessory support unit is rotatably connected to said hanging means.

12. The combination as set forth in claim 11 wherein said first rotatable shoe and accessory support means further comprises an additional shoe and accessory unit attached in tandem to the lower end of said first rotatable shoe and accessory unit.

13. The combination as set forth in claim 10 wherein said first rotatable shoe and accessory support means further comprises a utility tray conforming to the outer configuration of said first rotatable shoe and accessory unit, a plurality of vertical partitions cooperating with a vertical outer wall to form a plurality of compartments which can be used for storage of small personal items.

14. The combination as set forth in claim 12 wherein said first rotatable shoe and accessory support means further comprises a utility tray conforming to the outer configuration of said first rotatably shoe and accessory unit, a plurality of vertical partitions cooperating with a vertical outer wall to form a plurality of compartments which can be used for storage of small personal items.

15. The combination as set forth in claim 14 wherein said grid-like steel shelving is vinyl coated to present a pleasing appearance and prevent injury from any sharp edges thereon.

16. A suspension block for use with conventional shelving means, said suspension block comprising a rectangular main body support unit, said main body support unit provided with a centrally located main bore and a pair of pre-drilled apertures equidistantly spaced from said central main bore, a pair of hook means securely attached to said main body support unit, attachment means operatively received in said central main bore whereby said pair of hook means is engageable with said shelving means and said attachment means is utilized to rotatably suspend an object therefrom.

* * * * *